US005929877A

United States Patent [19]

Hetzer et al.

[11] Patent Number: 5,929,877

[45] Date of Patent: Jul. 27, 1999

[54] METHOD AND ARRANGEMENT FOR MAINTAINING THE NOZZLES OF AN INK PRINT HEAD CLEAN BY FORMING A SOLVENT-ENRICHED MICROCLIMATE IN AN ANTECHAMBER CONTAINING THE NOZZLES

[75] Inventors: Ulrich Hetzer; Jürgen Quass, both of Berlin, Germany

[73] Assignee: Franoctyp-Postalia AG & Co., Birkenwerder, Germany

[21] Appl. No.: 08/659,292

[22] Filed: Jun. 6, 1996

[30] Foreign Application Priority Data

Jun. 19, 1995 [DE] Germany ..... 195 22 593

[51] Int. Cl.[6] ..... B41J 2/165

[52] U.S. Cl. ..... 347/28; 347/22; 347/29

[58] Field of Search ..... 747/28, 40, 54, 747/92, 93, 22, 29.54, 22.92

[56] References Cited

U.S. PATENT DOCUMENTS

| | | | |
|---|---|---|---|
| 4,106,032 | 8/1978 | Miura et al. . | |
| 4,223,324 | 9/1980 | Yamamori et al. . | |
| 4,417,259 | 11/1983 | Maeda . | |
| 4,558,332 | 12/1985 | Takahashi . | |
| 4,638,336 | 1/1987 | Hofmann . | |
| 4,672,397 | 6/1987 | Suga et al. . | |
| 4,736,212 | 5/1988 | Oda et al. | 347/55 |
| 4,908,636 | 3/1990 | Saito et al. . | |

FOREIGN PATENT DOCUMENTS

| | | | |
|---|---|---|---|
| 0 285 155 | 10/1988 | European Pat. Off. . | |
| 0 713 774 | 5/1996 | European Pat. Off. | 347/54 |
| 35 23 428 | 1/1987 | Germany . | |
| 38 17 754 | 11/1989 | Germany . | |
| 38 25 045 | 1/1990 | Germany . | |
| 38 25 046 | 1/1990 | Germany . | |
| 41 01 95 | 8/1992 | Germany . | |
| 58-39465 | 3/1983 | Japan | B41J 03/04 |
| 2 025 853 | 7/1979 | United Kingdom . | |
| 2 280 149 | 6/1993 | United Kingdom . | |

OTHER PUBLICATIONS

Patent Abstracts of Japan, Vol. 13, No. 25 (M–787) for Application No. JP870072052.

Patent Abstracts of Japan, vol. 9, No. 111 (M–379) for Application No. JP830108703.

*Primary Examiner*—N. Le
*Assistant Examiner*—Thien Tran
*Attorney, Agent, or Firm*—Hill & Simpson

[57] ABSTRACT

A microclimate enriched by solvent vapors is produced in the antechamber during print operation and also predominates during the print pauses, the microclimate having a slightly higher pressure than the outer atmosphere. In this way all nozzles are equally protected against drying out. During print pauses of longer duration, the antechamber is closed and, if needed, is rinsed with solvent. The antechamber is formed by the ink print head being set back in relation to the front wall of the housing. In the front wall opposite the nozzles, openings are made whose width is larger than the diameter of a nozzle opening. The antechamber has a trough-shaped area for the inlet and outlet of solvent by capillary action, and a non-capillary area for the solvent vapors. A seal bonnet is provided for sealing during longer print pauses and cleaning processes.

20 Claims, 4 Drawing Sheets

METHOD AND ARRANGEMENT FOR MAINTAINING THE NOZZLES OF AN INK PRINT HEAD CLEAN BY FORMING A SOLVENT-ENRICHED MICROCLIMATE IN AN ANTECHAMBER CONTAINING THE NOZZLES

BACKGROUND OF THE INVENTION

1. Field of the Invention

The invention concerns a method and an arrangement for keeping the nozzles of an ink print head clean, in particular of an ink print head having a large number of nozzles.

2. Description of the Prior Art

Ink print heads are provided for use in small, fast printers, which themselves are a component of modern machines for franking postal materials or for printing addresses or for product labeling.

In contrast to the usual office printers with line-by-line printing, the printing ensues as a unique impression in one passage of the print medium. Due to this necessarily larger printing breadth (approximately an inch), the number of ink nozzles to be arranged under one another is substantially more than in ink print heads for office printers. In order to fulfill current customer desires (blocks with word and image characters) for franking machines with good print quality, print resolutions of close to 200 dpi (dots per inch) are required. This means ink print heads with 200 nozzles.

In these print heads it must be ensured that relevant security-oriented print image data, such as value, date and machine number for franking machines, are printed without omission of print points (dots).

Since fast-drying inks must be used, there is a high risk that the ink will dry in the nozzles that are not used (activated) for a longer time, or that the nozzles will become clogged by the accumulation of dust and ink residue in the area of the nozzles.

For preventing or remedying clogging of the nozzles, a number of different solutions is known, such as uncovering and vacuuming of the nozzle surface of the ink print head, expelling ink through all nozzles, wiping the nozzle surface with a wiping lip, and supplying cleaning agents to the nozzle surface; see German OS 38 10 698 and European Application 0 285 155.

All these measures have in common that they ensue exclusively during print pauses, whose spacing can be far apart in time from one another in printers that print frequently and for long durations, such as franking machines. Clogging is accordingly probable.

An ink jet printer with several nozzles is known (German OS 33 11 735) in which detection means registers when a nozzle or several nozzles are in an unused state for a predetermined time period, and in which the result of the detection is evaluated by control means, and ink is caused to be expelled through the nozzles concerned. In other words, the time duration of the print pauses is measured by signal measurement means, and if the print pause exceeds a predetermined time limit, rinsing of the nozzles used for printing is carried out by rinsing means before printing. In order to be fairly certain that the nozzles also remain truly capable of functioning, the print pauses must be relatively short; accordingly, the writing operation must be interrupted for the purpose of cleaning. Thus the operating time of the printer is reduced and the ink consumption is essentially increased by this cleaning method.

Furthermore, a cover for the nozzles of a partial-vacuum ink print head operating with fast-drying inks is known; cf.

European Application 0 173 939. By means of the cover, it is intended that the ink be prevented from drying at the nozzle ends in the print pauses, while it is also intended to ensure that the ink meniscus is neither touched nor pushed back.

For this purpose, the cover has a circumferential sealing element and a membrane, which form a pressure chamber when the cover is set on the nozzle surface. The internal tension of the membrane is smaller than the surface tension of the ink meniscuses. In this relatively small pressure chamber, a rapid saturation of the air with moisture occurs as a result of ink solution agents that evaporate at first, so that drying out of the nozzles is avoided over shorter print pauses. This arrangement, however, does not offer protection against nozzles drying out that are not used for a longer time during operation.

Another known apparatus (cf. German OS 38 25 045 and German OS 38 25 046) for cleaning the nozzle surface of an ink print head has a wiping element arranged movably in front of the nozzle surface, and in addition to the ink nozzles has a nozzle from which cleaning fluid is expelled against a guard screen and is diverted from this screen onto the nozzle surface. The wiping element is a belt that contains a number of openings adjacent to one another in the direction of the belt, the belt being transported past the nozzle surface in one direction. According to the position of the belt, the nozzles are released (opened) or covered. The belt is fashioned as an endless belt and is contained in a belt cartridge with a drive. During print operation, the belt lies with one of its openings in front of the nozzle openings and releases these openings for the expelling of ink. In the transition from print operation to print pause, at first cleaning fluid is expelled drop by drop through the cleaning nozzle. Subsequently the belt is moved forward in its direction of transport so far that instead of the opening, the following section of the belt moves in front of the nozzle surface and covers it. The edge of the opening wipes over the nozzle surface and thereby cleans this surface of accumulated contamination.

As is clear, this apparatus serves only for a rough cleaning of the nozzle surface. Clogging of the nozzle openings as the belt slides by is not precluded, nor is a drying out of nozzles.

In another known method (cf. German 32 03 014), an air cell is positioned in front of the nozzle opening for preventing clogging of the nozzles of an ink printer. This cell has an outer opening aligned with the nozzle opening, through which outer opening the ink drops fly onto the print medium. During operation, the ink jet is accompanied by an air jet from the air cell that annularly surrounds the ink jet, and is thereby accelerated. During a print pause, in order to keep the nozzle moist, the outer opening of the air cell is closed by means of a porous covering body and the moisture in the air cell is increased by letting ink into the air cell while the air is evacuated from the air cell.

At the beginning of the print operation, the ink in the air cell is rinsed out of this air cell through the outer opening by means of increased air pressure. For this purpose, the covering body is turned away, and a receptacle holder for the ink is brought in front of the outer opening. After emptying the air cell, the outer opening is blown free of ink by the air streaming through. The receptacle holder is removed and the print medium is brought into position.

The apparatus for accomplishing this known method includes an impulse-actuated pressure cell, an ink cell pressure-coupled with the pressure cell and connected to an ink cartridge via an ink duct, an air cell that is divided from the ink cell by a wall having a first opening and that is connected with the atmosphere by an outer opening, and a pump that during operation is connected with the air cell via an air line and that places the air line under a partial vacuum when operation is not taking place.

A cover apparatus can be positioned in front of the outer opening, and a valve is contained in the air line that relieves the pressure in the air line during non-pressure operation, and in preparation for the print operation raises the pressure so far that the ink contained in the air cell is pressed out through the outer opening. A receiving container, adjustable in two positions, is arranged for collecting the ink pressed out of the air cell.

An ink level state sensor in the air line switches off the supply of ink if the ink level reaches the sensor.

Although it is advantageous to integrate a part of the cleaning apparatus in the ink print head, this solution still has some disadvantages. Protection against drying out and clogging ensues in this known apparatus only during print pauses. The air stream during operation can lead to a faster drying out, at least for the nozzles that are seldom or not at all used. Since the printing ink is also used to maintain moisture in the print pauses and is then pressed into an external receptacle holder each time before printing begins, this procedure is costly with respect to time; moreover, ink is lost each time. Also, the ink meniscus can be pushed back to an undesirable extent.

Moreover, the mechanical expense (a covering body as well as a receptacle holder that can be positioned outside the ink head, and also a pump with a valve and a sensor inside the ink head) is considerable.

SUMMARY OF THE INVENTION

An object of the present invention is to increase the reliability of ink heads of the type described above at a low expense.

The underlying aim of the invention is to find a solution by means of which all the nozzles of an ink print head are protected against drying out both during print operation and in print pauses. In addition, the nozzles are to be extensively protected against contamination by paper dust, and the capability of cleaning ink residue deposits on the nozzle surface should also be possible.

The above object is achieved in a method and an apparatus wherein an antechamber is formed in front of the nozzle surface, between the nozzle surface and the housing in which the print head is disposed. A microclimate is produced in this antechamber enriched with solvent vapors, the microclimate being produced during print operation and predominating during print pauses. A cleaning nozzle arrangement can also be provided for rinsing the antechamber with solvent, as needed. The solvent which is used is suitable for cleaning the particular type of ink which is employed, and the solvent may be of a type which is easily volatile at room temperature, or a heating element may be provided if a solvent which is only volatile above room temperature is employed.

A trough-shaped area may be formed, such as in the housing, for the solvent which draws solvent into, and discharges solvent from, the area for the solvent vapors by capillary action, with a seal bonnet being placed over the front of the housing so that the antechamber is formed between the seal bonnet and the nozzle surface of the ink print head.

The microclimate of solvent vapors during the print operation, and predominating also in the print pauses, protects all nozzles equally from drying out. The antechamber has only a small volume, because the spacing between the nozzle surface and the print medium may not exceed 2 mm, as a rule; as a result, no essential solvent consumption, and thus also no additional environmental stress, takes place. The solvent is usually colorless, so that the formation of shadows on the print medium by small amounts of escaping solvent vapors is prevented. If sufficiently volatile components are contained in the solvent, then the ink print head temperature already suffices for the evaporation. Otherwise the solvent is additionally heated upon entering the antechamber. Due to the evaporation, there will always be a slightly higher pressure in the antechamber in relation to the outer atmosphere. This excess pressure prevents dust from flowing into the antechamber and thus from reaching the nozzle surface. If over time ink residues have collected in the area of the nozzle openings, these are removed by rinsing with the solvent. For this purpose, the antechamber is closed and rinsed and the rinsing agent is auctioned out and filtered. The antechamber is usefully closed during print pauses of longer duration, as is standard.

The method is suited both for ink print heads having piezoactuators and for bubble-jet technique ink print heads. In both cases it is possible to use parts of the ink print head for carrying out the method.

The antechamber is formed by an appropriate arrangement of the ink print head in its housing, which is required in any case, by placing the nozzle surface recessed back somewhat in relation to the front wall of the housing. If the ink print head has rows of nozzles, matched openings are provided in the front wall whose width b is larger than the diameter d of a nozzle opening. The openings are usefully formed as drawn-out slots, however, they may also be bores. Slots are easier to manufacture and to clean.

The antechamber is connected with a container for solvent for the ink via at least one nozzle together with an allocated duct.

An area at the edge of the antechamber is fashioned in the shape of a trough. The solvent for the formation of the solvent vapors is admitted into this area via at least one nozzle. This nozzle is constructed analogously to the ink nozzles, and has the same drive (pressure chamber with actuator). In this way, the supply of solvent can ensue in as fine a dosage as is desired. For this purpose, this part of the chamber is constructed as a capillary space. The nozzle with supply is preferably a component of the ink print head. It is also possible, however, to integrate it into the housing.

The other area of the antechamber is provided for the reception of the solvent vapors, and forms the overall area in front of the ink nozzles.

The trough-shaped area is connected with the remaining area of the antechamber via slots.

Adjacent to the housing, a seal bonnet is adjustably positioned so that it can be non-positively (removably) mounted in front of the front wall. The course of motion is thereby formed so that a wiping lip coupled with the seal bonnet is led over the openings/slots in the wiping direction. Dust deposits on the front wall are thereby stripped off. A suction plate is exchangeably arranged in the seal bonnet, by means of which the openings are tightly sealed. The suction plate can be made of foamed material or of felt, so that during rinsing processes in the antechamber, liquid residues are wicked from the openings and a drain off is avoided. As a rule, the housing is closed with the seal bonnet during longer print pauses.

In order to enable rapid cleaning or rinsing of the ink print head, at least one nozzle and its associated duct to the container with the solvent are constructed larger than the remaining nozzles and their ducts. In order to prevent an unwanted outflow of solvent, a valve is arranged in the duct. A pump installed in the solvent duct is actuated for the rinsing process. The rinsing agent flows back into the solvent container via an exchangeable filter. In order to ensure a good distribution of the solvent vapors in the antechamber and an effective rinsing, the spacing between the inner side, the front wall and the nozzle surface is large enough to preclude a capillary action.

If the operating temperature of the ink print head is not sufficient to form enough solvent vapors, a heating means can be arranged in the trough-shaped area for aiding evaporation.

It is also possible to arrange heating means around the nozzle. The use of such heating means is particularly advantageous if a bubble jet ink print head is used whose ink is water-based.

DESCRIPTION OF THE PREFERRED EMBODIMENTS

The figures are shown schematically to facilitate the representation and comprehension.

Figure 1:
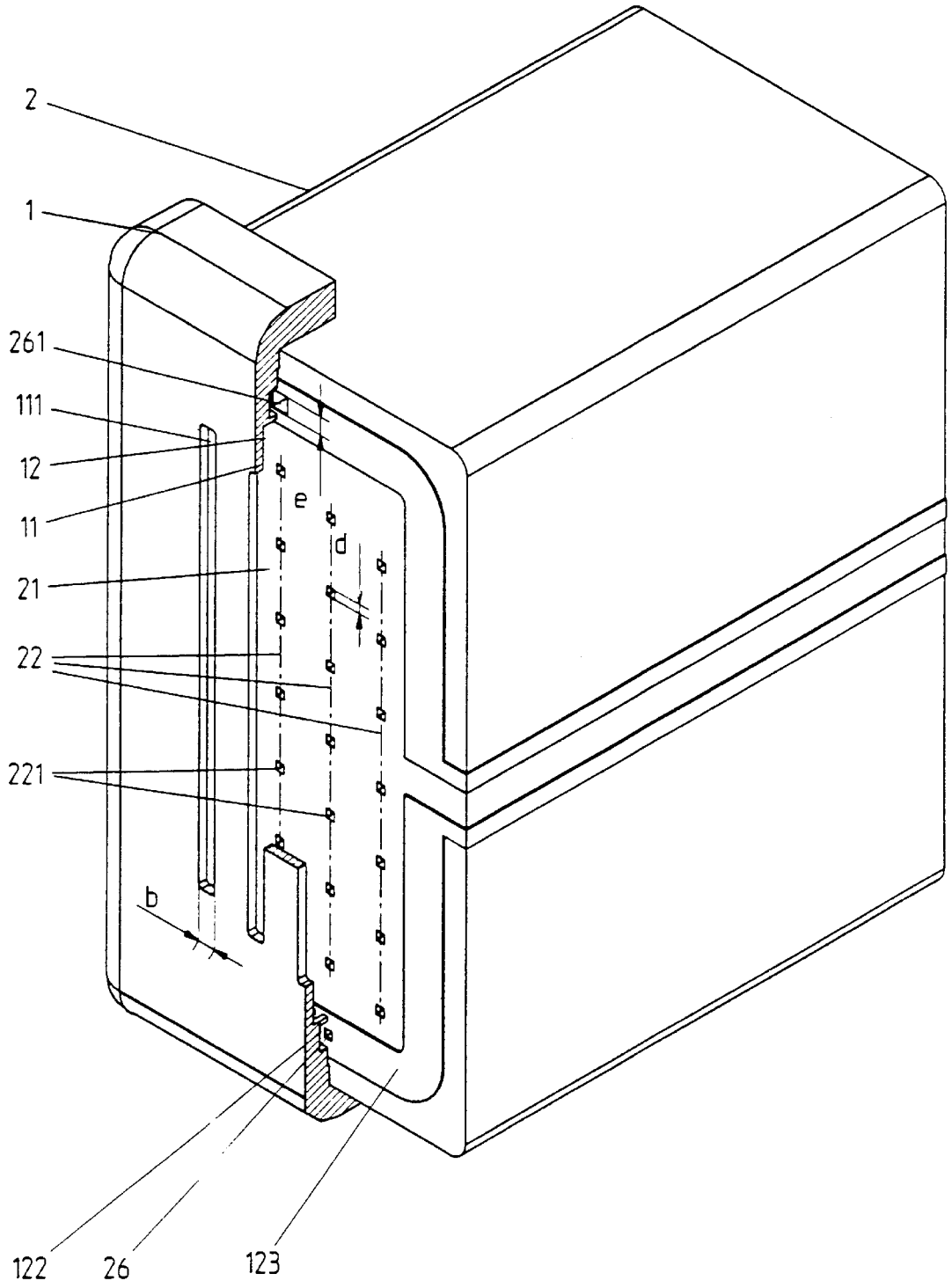
FIG. 1 is a perspective view of an ink print head with housing, constructed and operating in accordance with the principles of the present invention partly sectional in the front area.

According to FIG. 1, an ink print head 2 is positioned in a housing 1. The ink print head 2 has four nozzle rows 22, having nozzles 221 for ink 31 (see FIG. 3) and nozzles 26 and 261 for solvent 41 (also shown in FIG. 3).

Figure 3:
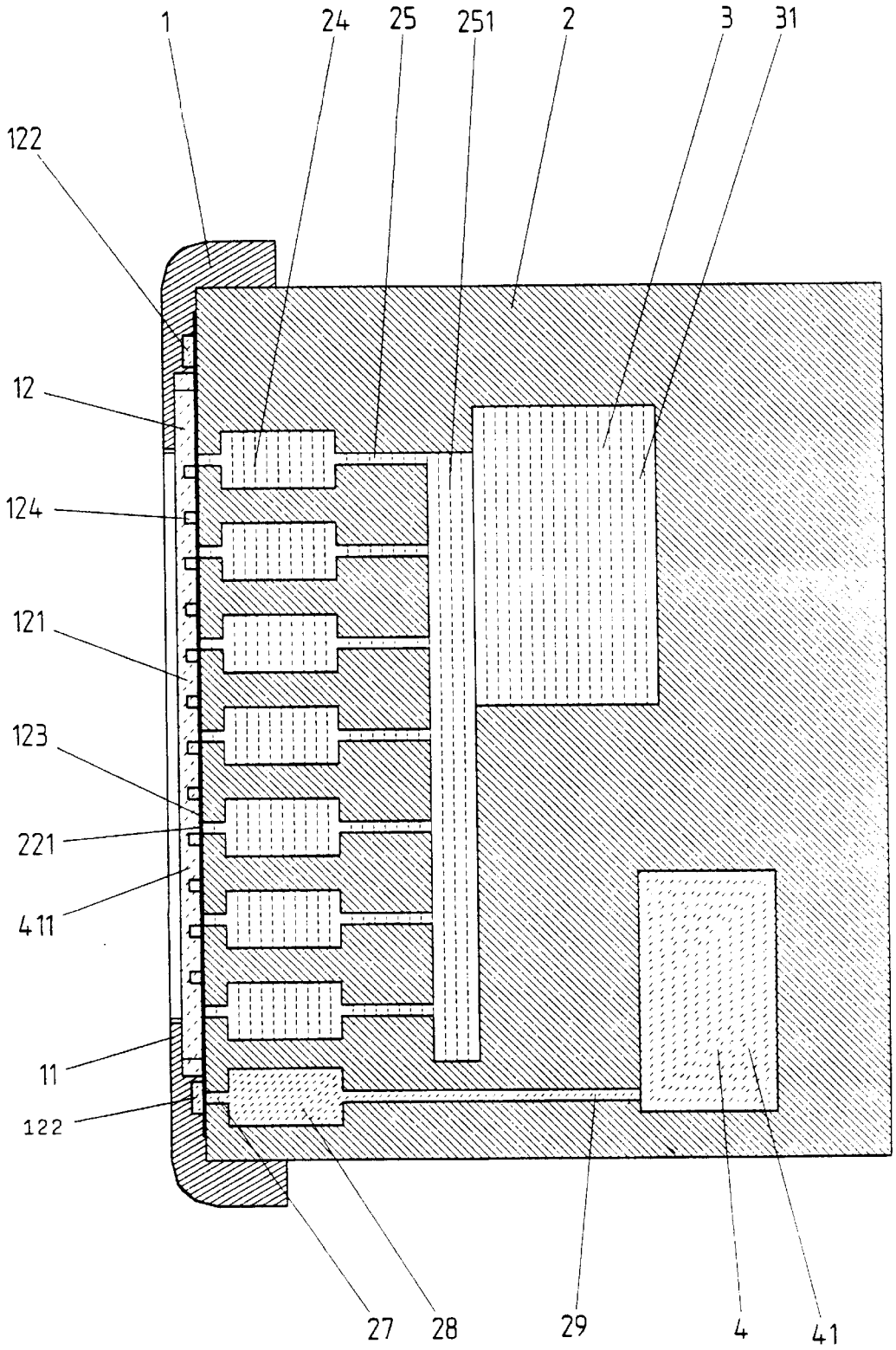
FIG. 3 is a longitudinal section through an ink print head constructed and operating in accordance with the principles of the present invention having identical nozzles, taken along a row of nozzles.

A heating element 123 serves to generate solvent vapors 411 (FIG. 3). Slot-shaped openings 111 are formed into the front wall 11 of the housing 1. The slots 111 are aligned with the nozzle rows 22 in the direction of the ink flow. The width b of a slot 111 is so much larger in relation to the diameter d of a nozzle 221 that the drops of ink can pass unhindered through the slot 111. The diameter e of an enlarged nozzle 261 for solvent 41 is dimensioned so that an antechamber 12 is sufficiently rapidly filled with solvent 41 and rinsed. The antechamber 12 is formed by the volume between the front wall 11 and the nozzle surface 21.

Figure 2:
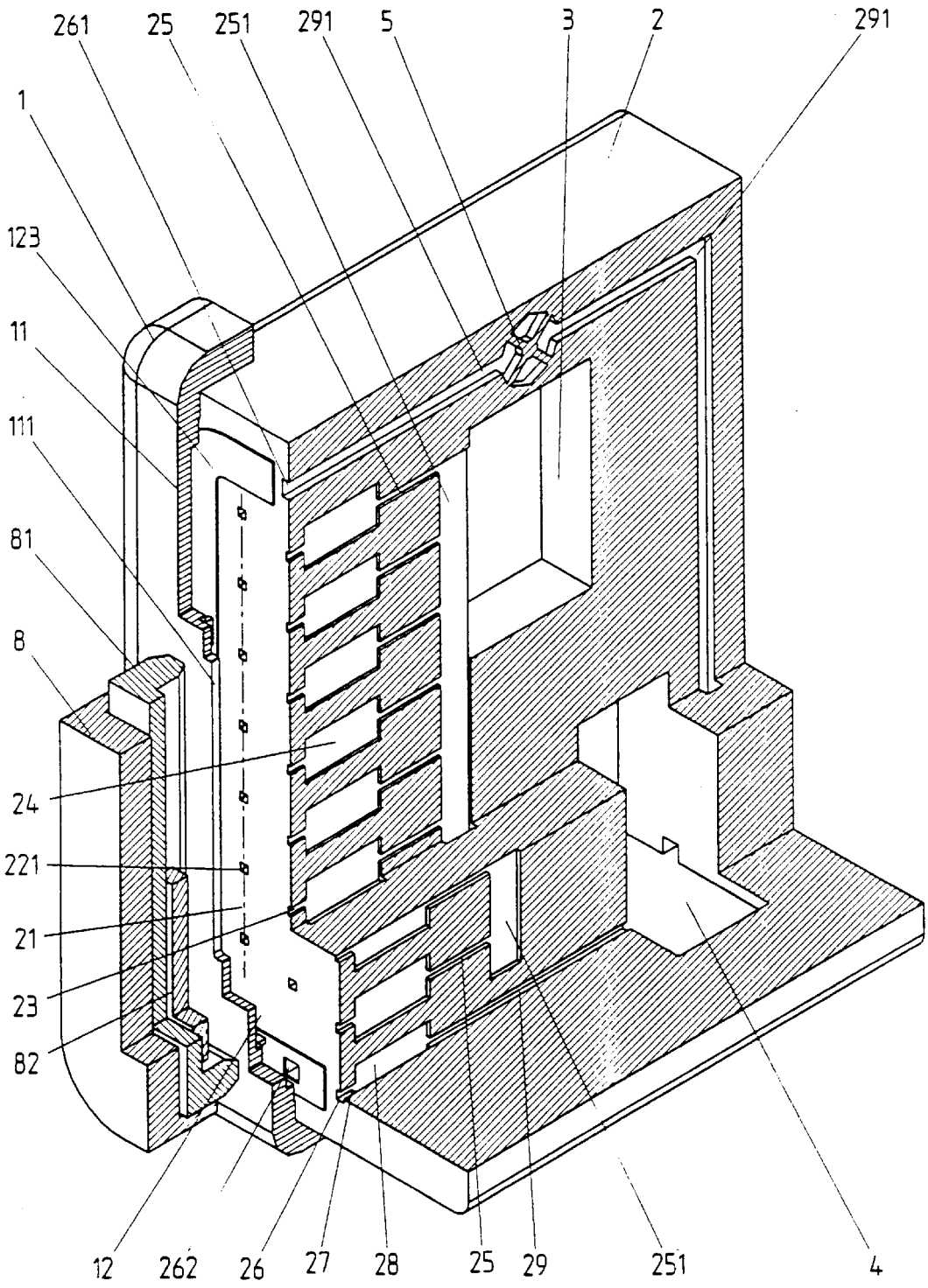
FIG. 2 is a perspective view of an ink print head with housing and applied seal bonnet, sectioned stepwise constructed and operating in accordance with the principles of the present invention.

As shown in FIG. 2, the ink 31 is conducted from a container 3 via a common ink supply duct 251 to an individual ink supply duct 25 and from this duct into an ink pressure chamber 24. The ink pressure chamber 24 is driven by actuators that are not shown. In a piezo ink print head, these are piezotransducers or piezoactuators. In a bubble jet ink print head, these are heat resistors in the form of emitter resistors in transistor driver circuits. The ink 31 flows from the ink pressure chamber 24 through a nozzle duct 23 to the nozzle and from this onto a print medium.

For the generation of solvent vapors 411, the solvent 41 is conducted from a container 4 via a solvent supply duct 29 to a solvent pressure chamber 28, and from this is conducted via a nozzle duct 27 to a nozzle 26 (see also FIG. 3). The solvent pressure chamber 28 is driven in the same way as the ink pressure chamber 24. Although rinsing is possible in principle via this path, with correspondingly larger drive energy and longer filling time for the antechamber 12, it is not effective at that location.

For this purpose, a further connection exists through an enlarged solvent duct 291 from the container 4 via a pump 5 to an enlarged nozzle opening 261 in the antechamber 12. The antechamber 12 is covered during the rinse process by means of a seal bonnet 8 applied to the front wall 11 (see also FIG. 4).

The seal bonnet 8 is placed non-positively on the front surface of the front wall 11 with a circumferential wiping lip 81. A suction plate 82, in which escaping solvent 41 is bound, is exchangeably attached in the seal bonnet 8. The suction plate 82 can be formed of a fleece or sponge. The backflow of the solvent 41 serving for rinsing ensues via the nozzles 262, the solvent duct 292, and an exchangeable filter 6 through a valve 7 into the container 4 (cf. FIG. 4). The ink residue contained in the solvent 41 is bound in the filter 6. The valve 7 and the pump 5 prevent solvent 41 from flowing into the antechamber 12 via this path during print operation.

Figure 4:
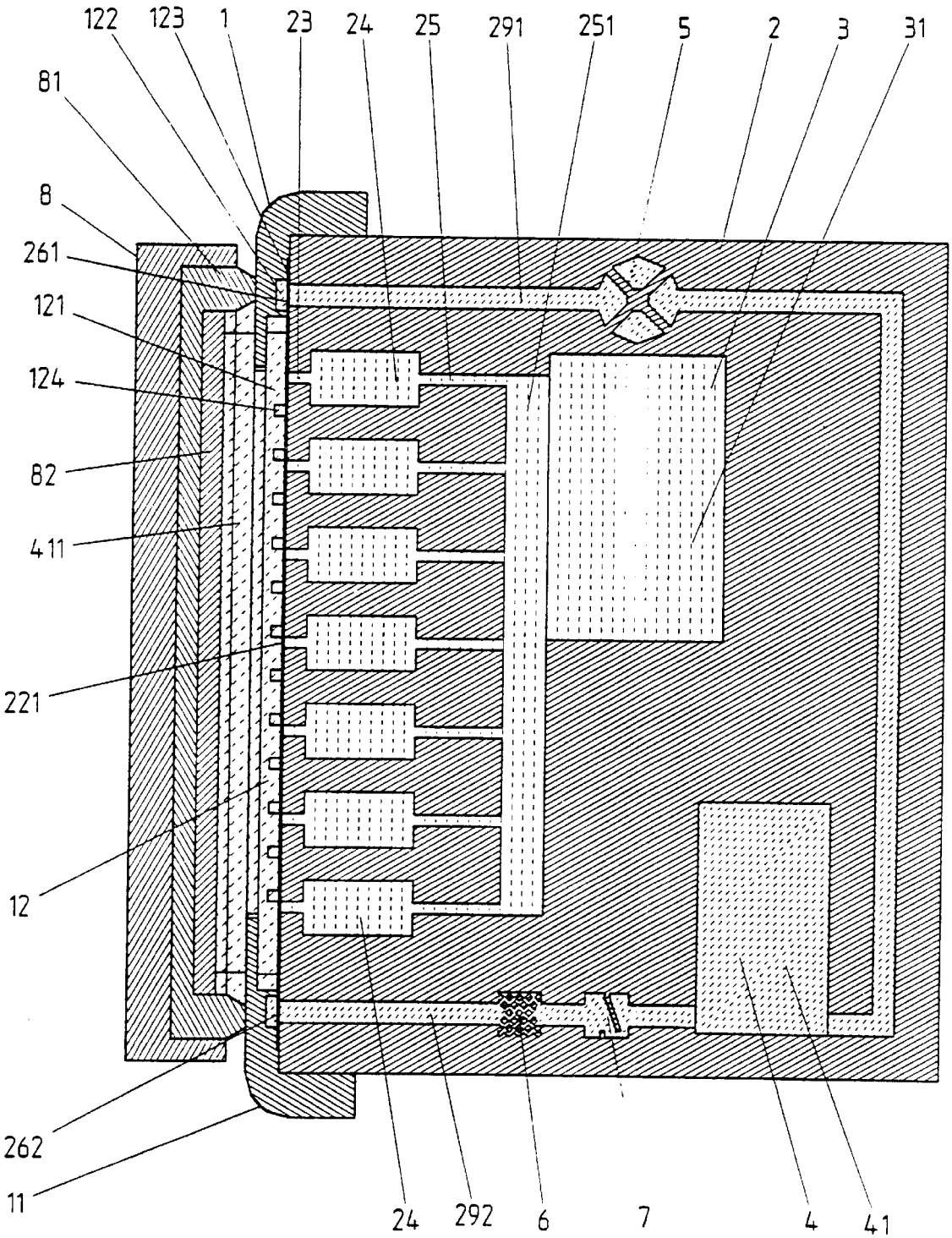
FIG. 4 is a longitudinal section through an ink print head with applied seal bonnet constructed and operating in accordance with the principles of the present invention having nozzles of different sizes, taken along a row of nozzles.

As can be seen from FIGS. 3 and 4, the antechamber 12 has a trough-shaped area 122 lying in the edge area, and an area 121 in front of the ink nozzles 221. The areas 121 and 122 are connected with one another via capillary slots 124, from which the solvent vapors flow from the area 122 into the area 121. The area 122 is formed as a circumferential capillary space. The heating element 123 is also located in this area.

The schematically shown container 3 for ink in the ink print head 2 and container 4 for solvent 4 are kept relatively small and are connected with correspondingly large external containers through suitable connections, in a way not shown in more detail.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for keeping nozzles of a print head clean, comprising the steps of:

arranging a plurality of nozzles in a nozzle surface of a printhead including a plurality of ink nozzles and at least one solvent nozzle;

forming an antechamber in front of said nozzle surface and thus in front of all of the nozzles in said plurality of nozzles;

providing individual drives respectively for said ink nozzles for respectively ejecting ink from said ink nozzles;

providing at least one solvent nozzle drive for said at least one solvent nozzle; and supplying liquid solvent to said antechamber by operating said at least one solvent drive to eject liquid solvent via said at least one solvent nozzle and volatilizing said liquid solvent in said antechamber to produce a microclimate in said antechamber enriched with solvent vapors interacting with all of said ink nozzles in said plurality of nozzles during print operation and predominating during print pauses.

2. A method as claimed in claim 1 further comprising sealing said antechamber during print pauses of long duration.

3. A method as claimed in claim 2 comprising the additional step of:

rinsing said antechamber with solvent after a print pause of long duration.

4. A method as claimed in claim 1 wherein the step of producing said microclimate includes producing said microclimate in said antechamber at a pressure higher than ambient pressure outside said antechamber.

5. A method as claimed in claim 1 wherein the step of producing said microclimate includes producing said microclimate using solvent vapors from a solvent which is easily volatile at room temperature.

6. A method as claimed in claim 1 wherein the step of producing said microclimate includes producing solvent vapors in said microclimate by heating a solvent above room temperature.

7. An arrangement as claimed in claim 6 further comprising heating means disposed in said trough-shaped area for volatizing said solvent.

8. An arrangement for keeping nozzles of an ink print head clean, comprising:

a housing having a front wall;

an ink print head disposed in said housing, said ink print head having a nozzle surface containing a plurality of nozzles including a plurality of ink nozzles and at least one solvent nozzle, said nozzle surface being set back relative to said front wall and forming an antechamber in combination with said front wall between said front wall and said nozzle surface, and said antechamber thus being disposed in front of all of the nozzles in said plurality of nozzles;

a plurality of ink nozzle drives, equal in number to said plurality of ink nozzles, for respectively individually driving said ink nozzles to eject ink therefrom;

said housing having openings therein in registry with said nozzles, said openings being larger than a diameter of a nozzle;

a container containing liquid solvent in fluid communication with said antechamber through a solvent duct terminating at said least one solvent nozzle in said nozzle surface;

at least one solvent nozzle drive for said at least one solvent nozzle operable to eject said liquid solvent from said at least one solvent nozzle, said liquid solvent volatilizing in said antechamber and forming a volatilized solvent-enriched microclimate in said antechamber interacting with all of said ink nozzles in said plurality of nozzles;

said antechamber having a trough-shaped area for recovering liquid solvent and an area for solvent vapors in said microclimate; and a seal bonnet surrounding said front wall disposed adjacent said housing.

9. An arrangement as claimed in claim 8 wherein said at least one solvent nozzle and said solvent duct have a diameter larger than the diameter of said ink nozzles.

10. An arrangement as claimed in claim 8 further comprising a one-way valve disposed in said solvent duct for preventing outflow of liquid solvent.

11. An arrangement as claimed in claim 8 wherein said at least one solvent nozzle and said solvent duct are integrated in said print head.

12. An arrangement as claimed in claim 8 wherein said solvent nozzle and said solvent duct are formed in said housing.

13. An arrangement as claimed in claim 8 further comprising pumping means disposed in said solvent duct for pumping solvent from said container through said solvent duct.

14. An arrangement as claimed in claim 8 further comprising a filter exchangeably disposed in said solvent duct.

15. An arrangement as claimed in claim 8 wherein said ink nozzles are arranged in a plurality of rows, and wherein said openings comprise slots respectively in registry with said rows of nozzles.

16. An arrangement as claimed in claim 8 wherein said trough-shaped area comprises a capillary space having capillary slots leading to said area for solvent vapors.

17. An arrangement as claimed in claim 8 wherein said area for solvent vapors has dimensions precluding capillary action.

18. An arrangement as claimed in claim 8 further comprising heating means for heating said solvent disposed in an area of said solvent nozzle.

19. An arrangement as claimed in claim 8 wherein said seal bonnet comprises a wiping lip disposed adjacent said housing.

20. An arrangement as claimed in claim 8 further comprising a suction plate exchangeably disposed in said seal bonnet for collecting solvent.

* * * * *

UNITED STATES PATENT AND TRADEMARK OFFICE

CERTIFICATE OF CORRECTION

PATENT NO. : 5,929,877
DATED : July 22, 1999
INVENTOR(S) : Hetzer et al.

It is certified that error appears in the above-identified patent and that said Letters Patent is hereby corrected as shown below:

The spelling of the Assignee at item [73] on page 1 is changed from Franocytp-Postalia AG & Co. to -- Francotyp-Postalia AG & Co.--.

Signed and Sealed this

Third Day of July, 2001

*Attest:*

Nicholas P. Godici

NICHOLAS P. GODICI
*Acting Director of the United States Patent and Trademark Office*

*Attesting Officer*